US010973288B2

(12) United States Patent
Takessian

(10) Patent No.: US 10,973,288 B2
(45) Date of Patent: Apr. 13, 2021

(54) APPARATUS AND METHOD OF MANUFACTURE OF A JEWELRY SETTING

(71) Applicant: Garabed Takessian, Canton, MI (US)

(72) Inventor: Garabed Takessian, Canton, MI (US)

( * ) Notice: Subject to any disclaimer, the term of this patent is extended or adjusted under 35 U.S.C. 154(b) by 159 days.

(21) Appl. No.: 15/914,709

(22) Filed: Mar. 7, 2018

(65) Prior Publication Data

US 2019/0274400 A1 Sep. 12, 2019

(51) Int. Cl.

| | |
|---|---|
| ***A44C 17/02*** | (2006.01) |
| ***A44C 17/04*** | (2006.01) |
| *A44C 9/00* | (2006.01) |

(52) U.S. Cl.

CPC ..... *A44C 17/04* (2013.01); *A44C 17/02* (2013.01); *A44C 9/00* (2013.01)

(58) Field of Classification Search

CPC ..... A44C 17/00; A44C 17/02; A44C 17/0208; A44C 17/0216; A44C 17/0225; A44C 9/00; A44C 9/0053; A44C 9/0084; A44C 9/0007

USPC ..... 63/26, 27, 29.1; D11/34, 35, 36, 26

See application file for complete search history.

(56) References Cited

U.S. PATENT DOCUMENTS

| | | | | |
|---|---|---|---|---|
| 1,864,371 A | | 6/1932 | Prussian | |
| 1,941,782 A | * | 1/1934 | Bager | A44C 17/02 63/27 |
| 2,239,302 A | * | 4/1941 | Pritchard | A44C 17/02 63/27 |
| 2,394,794 A | * | 2/1946 | Manne | A44C 9/00 63/15 |
| 3,014,354 A | * | 12/1961 | McCary | A44C 17/02 63/27 |
| D217,492 S | * | 5/1970 | Gotze | D11/92 |
| D246,354 S | * | 11/1977 | Durante | D11/36 |
| 4,311,026 A | * | 1/1982 | Ochoa | A44C 9/00 29/896.412 |
| 4,936,115 A | * | 6/1990 | Mesica | A44C 17/02 63/26 |
| 5,664,440 A | * | 9/1997 | Roemer | A44C 17/002 63/15 |
| D393,227 S | * | 4/1998 | Roemer | D11/34 |
| 5,868,008 A | * | 2/1999 | Yamaura | A44C 17/006 63/15 |
| D421,404 S | * | 3/2000 | Canale | D11/26 |
| 7,127,916 B2 | * | 10/2006 | Ruth | A44C 17/002 63/28 |
| 7,155,933 B2 | * | 1/2007 | Pourmehdi | A44C 9/0053 63/15 |
| D630,541 S | * | 1/2011 | Shimansky | D11/26 |
| D675,952 S | * | 2/2013 | Dholakiya | D11/34 |
| D676,777 S | * | 2/2013 | Williams | D11/26 |
| D780,015 S | * | 2/2017 | Blum | D11/34 |
| 2004/0237585 A1 | | 12/2004 | Golden et al. | |
| 2005/0056054 A1 | | 3/2005 | Pourmehdi | |
| 2005/0188722 A1 | | 9/2005 | Nevatia et al. | |

(Continued)

FOREIGN PATENT DOCUMENTS

| | | | | |
|---|---|---|---|---|
| GB | 2270458 A | * | 3/1994 | A44C 17/02 |

*Primary Examiner* — Emily M Morgan

(74) *Attorney, Agent, or Firm* — Carrier Blackman & Associates, P.C.; Joseph P. Carrier; William D. Blackman

(57) ABSTRACT

A jewelry assembly and method of fabricating includes a support, a sub-assembly attached to the support, the sub-assembly including a base plate having an upper surface, and a center stone having a culet and pavilion positioned above the upper surface.

10 Claims, 14 Drawing Sheets

(56) References Cited

U.S. PATENT DOCUMENTS

| | | | | |
|---|---|---|---|---|
| 2006/0107692 | A1 | 5/2006 | Lindenman | |
| 2007/0157665 | A1* | 7/2007 | Lai | A44C 17/02 63/26 |
| 2008/0163647 | A1 | 7/2008 | Rosen | |
| 2008/0184739 | A1* | 8/2008 | Huynh | A44C 17/001 63/26 |
| 2008/0314083 | A1* | 12/2008 | Wanstrath | A44C 9/00 63/26 |
| 2009/0071192 | A1* | 3/2009 | Bauman | A44C 17/046 63/15 |
| 2009/0199593 | A1 | 8/2009 | Corvino | |
| 2011/0041555 | A1 | 2/2011 | Huynh | |
| 2013/0227989 | A1 | 9/2013 | Kothari | |
| 2014/0102140 | A1 | 4/2014 | Nhaissi | |
| 2016/0021993 | A1 | 1/2016 | Nevatia | |
| 2019/0298012 | A1* | 10/2019 | Das | A44C 17/02 |

* cited by examiner

APPARATUS AND METHOD OF MANUFACTURE OF A JEWELRY SETTING

CROSS REFERENCE TO RELATED APPLICATION

Technical Field

This disclosure relates generally to arrangements for gemstones and gemstone, or more generally, for jewelry settings. More particularly, the disclosure relates to an apparatus and method of manufacture of a jewelry setting.

BACKGROUND

Gemstone arrangements, or jewelry in general, seek to enhance the appearance and visual characteristics of gemstones by taking advantage of their reflective and/or refractive characteristics. This may be done by abutting gemstones such that many smaller gemstones appear to be a single larger and a more valuable gemstone. Different mounting systems can also enhance the appearance. Gemstones can be arranged to enhance the natural beauty of the arrangement, taking advantage of the reflective and/or refractive characteristics of a composite of gemstones. Complementary arrangements may also position several gemstones in relation to a central gemstone such that light from the complementary gemstones is introduced to the central gemstone, further enhancing the beauty of the central gemstone and the overall arrangement.

Some known arrangements position smaller gemstones along and proximate to a pavilion of the central gemstone to enhance the visual interaction between the smaller gemstones and the central gemstone. Other known arrangements position a central gemstone above an array of cylindrically mounted smaller stones, with the intention to visually enhance the central gemstone.

Various settings may be employed, as well. For instance, a prong setting having a central gemstone set in a traditional mounting can be mounted with respect to smaller gemstones that are positioned about a ring guard or wrap of the main band. A channel setting may include a set of channels spanning to either side of a central gemstone, the gemstone itself held by prongs which, in turn, are supported by the channel setting. Another known setting includes a bezel setting, in which a central gemstone is held by a rim that surrounds and holds the gemstone. One known setting, the gypsy setting, includes a band that is shaped like a dome and is a continuous piece that gets thicker at the top, such that a central gemstone is positioned within the domed portion. A tension setting holds a central gemstone in place by pressure from bands of metal to either side of the central gemstone. In fact, there are numerous known settings in which a central gemstone is positioned with respect to smaller gemstones.

However, known settings may not include sufficient proximity to smaller gemstones and may therefore not sufficiently enhance the reflective and refractive properties of the central gemstone. And, known settings may not sufficiently support the central gemstone, as it may be held significantly above other aspects of the setting (such as the smaller gemstones). Thus, support of the central gemstone may be insufficient, and the various settings may be subject to damage during assembly and/or use. Further, placement of a culet of the central gemstone proximate other aspects of the setting can lead to damage of the culet, and/or damage of smaller gemstones or other aspects of the arrangement that the culet is near.

Thus, there is a continuing need to provide a simplified gemstone arrangement having visually enhanced characteristics for the central gemstone, while providing for ease of fabrication and reduced long-term risk of damage to the central gemstone.

BRIEF DESCRIPTION

The disclosed subject matter is directed toward an apparatus and method of manufacturing a jewelry setting.

According to the disclosure, a jewelry assembly includes a support, a base plate attached to the support, the base plate having an upper surface, a center stone having a culet and pavilion, wherein at least a main portion of the center stone is positioned at least in part above the upper surface, and a plurality of secondary jewelry stones which are smaller than the center stone and are positioned on the upper surface of the base plate such that many of the secondary jewelry stones are disposed directly beneath and visible beneath the pavilion of the center stone, wherein the secondary jewelry stones cover most or all of a central portion of the base plate upper surface such that the secondary jewelry stones are visible around the center stone.

According to the disclosure, a method for fabricating a jewelry assembly includes providing a support, providing a base plate having an upper surface, providing a center stone having a culet and pavilion and positioning the center stone so that at least a main portion of the center stone is disposed above the base plate, providing a plurality of secondary jewelry stones which are smaller than the center stone and positioned on the upper surface of the base plate such that many of the secondary jewelry stones are disposed directly beneath and visible beneath the pavilion of the center stone; and attaching the base plate and center stone to the support, wherein the secondary jewelry stones cover most or all of a central portion of the upper surface of the base plate such that the secondary jewelry stones are visible around the center stone.

Various other features and advantages will be made apparent from the following detailed description and the drawings.

DETAILED DESCRIPTION

Figure 1:
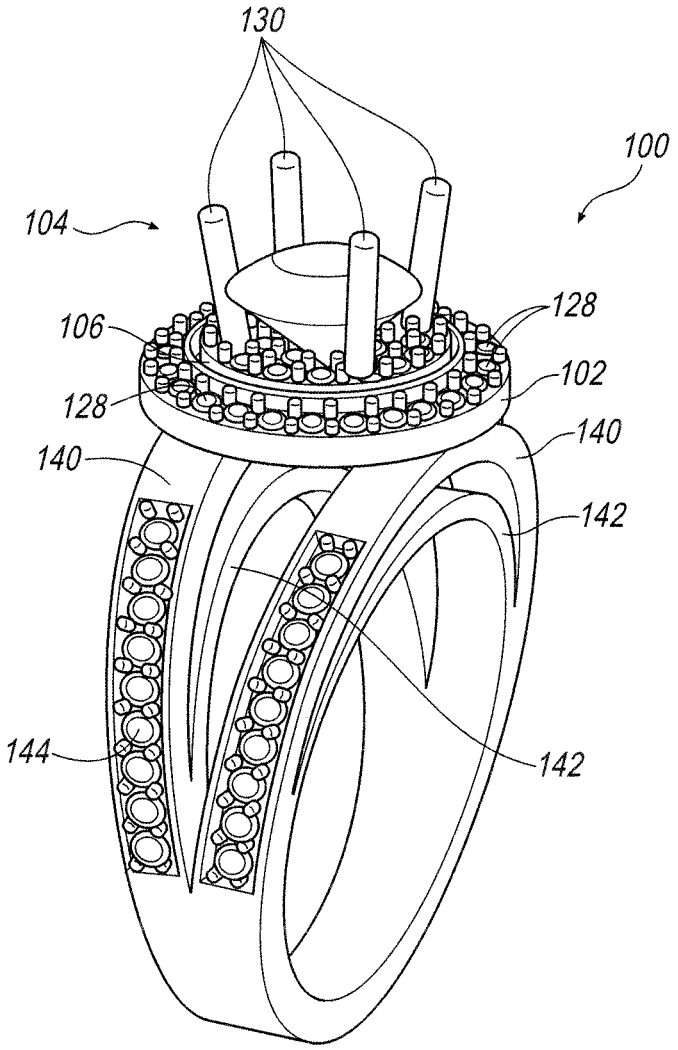
FIG. 1 is a perspective view of a jewelry assembly according to an embodiment of the present invention as-assembled.

The environment of the disclosed apparatus and method is generally directed toward a jewelry or a gemstone setting. Disclosed generally is a jewelry assembly having a center stone positioned by a support above a sub-assembly. The sub-assembly includes a base plate, and the base plate may include multiple secondary stones positioned beneath the center stone. The center stone includes a culet and pavilion that are positioned above the base plate. In one example, the base plate may include a center hole, positioned below the center stone, such that the culet may project at least a portion thereof into the center hole. The center stone may be positioned closer to the base plate (and any secondary stones thereon) than otherwise would be achievable with no center hole. In such fashion, the center stone, being positioned proximate the secondary stones, is thereby favorably positioned to enhance not only the reflective and refractive features of the center stone, but of the secondary stones as well, leading to a shimmering and comfortable presentation that enhances the center stone and surrounding secondary stones, their greater visibility and less metal visible. And, in examples that include a center hole, the center hole may be appropriately sized to determine how high or low to set the center stone, based on the depth of cut of the center stone, as well as how deep within the center hole the center stone may be positioned. A center hole also prevents a sharp end, such as a culet, from damaging the base plate or any stones positioned thereon.

Disclosed also is a corresponding method of fabricating the jewelry or gemstone setting. In one example, the support for the center stone and the base plate may be cast as one piece, such that the center stones and secondary stones may be assembled as one piece. Such a casting may also include a band or bracelet, depending on the final jewelry product, and may include the setting implements as well (prong, channel, etc.). In this example, the center stone and any additional stones (such as the secondary stones) may be of a type that may or may not be capable of taking a high degree of heat without damage. That is, a single piece casting enables a flexible design that can incorporate any type of stone. In addition, casting as a single piece will result in a single material type.

In another example, the base plate may be fabricated separate from its support. In this example, secondary stones may be attached to the base plate, but having stones that are not capable of taking a high degree of heat. Stones may be placed into a portion of the setting, and then the base plate may be laser-soldered, as an example, to the support using a low-temperature process, such as laser soldering, so as not to damage the stones on the base plate. Stones that may generally be considered to be able to take a high degree of heat without damage include, but are not limited to, diamonds, ruby, and sapphire. Stones that generally may not take a high degree of heat include, but are not limited to, opal, emeralds, and garnet. Further, casting the base plate separate from its support enables different materials for each, as well. Thus, the base may be one type of gold and the support may be another type of gold, as an example. In one example a ring, support, and base plate may be fabricated all from the same material and as one casting, having a halo added thereto to surround the base plate.

In general, the disclosed apparatus and method are applicable to a wide variety and combination of stones, setting types, jewelry types, and metal types. The stones used as the center stone and/or other stones in the setting may be precious gemstones such as diamonds, rubies, sapphires, emeralds, blue stones, and birth stones. Stones may also include opal, emerald, garnet, talc, topaz, feldspar, amber, and amethyst, as a few examples. Various setting types are included in the disclosure, including but not limited to prong, illusion, bezel, channel, pave', bar, invisible, tension, and cluster settings. Prong types, in addition, may include single, double, triple, or even additional prongs to setting the center stone, and the number of prongs can be any number, such as two, three, or more. Further, support for the center stone may be in the base plate itself, or may be external to the base plate, such as from the support of from a ring band itself. Jewelry types include but are not limited to rings, bracelets, and brooches, to name but a few. The settings may be fabricated using precious metals, to include but not limited to gold, silver, platinum, and palladium, or contemporary metals such as titanium or stainless steel.

Thus, disclosed is an apparatus and method of fabricating a jewelry or gemstone setting that may include any combination of the above stones, setting types, jewelry types, and metal types. In some examples, the jewelry or gemstone setting is fabricated from a single piece of cast metal. In other examples, stones may be used that may be prone to damage from high heat operations, in which case a separate base plate may be assembled and then joined with the main arrangement.

Accordingly, although the following descriptions include general references and illustrations that include diamonds, it is contemplated that all disclosed designs may incorporate other combinations of stones, setting types, jewelry types, and metal types. Further, in a design that includes a diamond center stone, and/or diamonds as additional stones in the setting, the diamond may be cut as conventionally understood, to include a table, crown, girdle, pavilion, and a culet. Diamonds may be cut shallow, ideal, or deep, depending on the overall design and the proximity to and desire for visual effect with other stones within the setting. The stones may be faceted or unfaceted.

Further, although the base plate in the disclosed examples is circular, it is contemplated that any shape may be employed, such as oval, cushion, pear, marquise, square, heart, or half-moon, to name a few.

Figure 2:
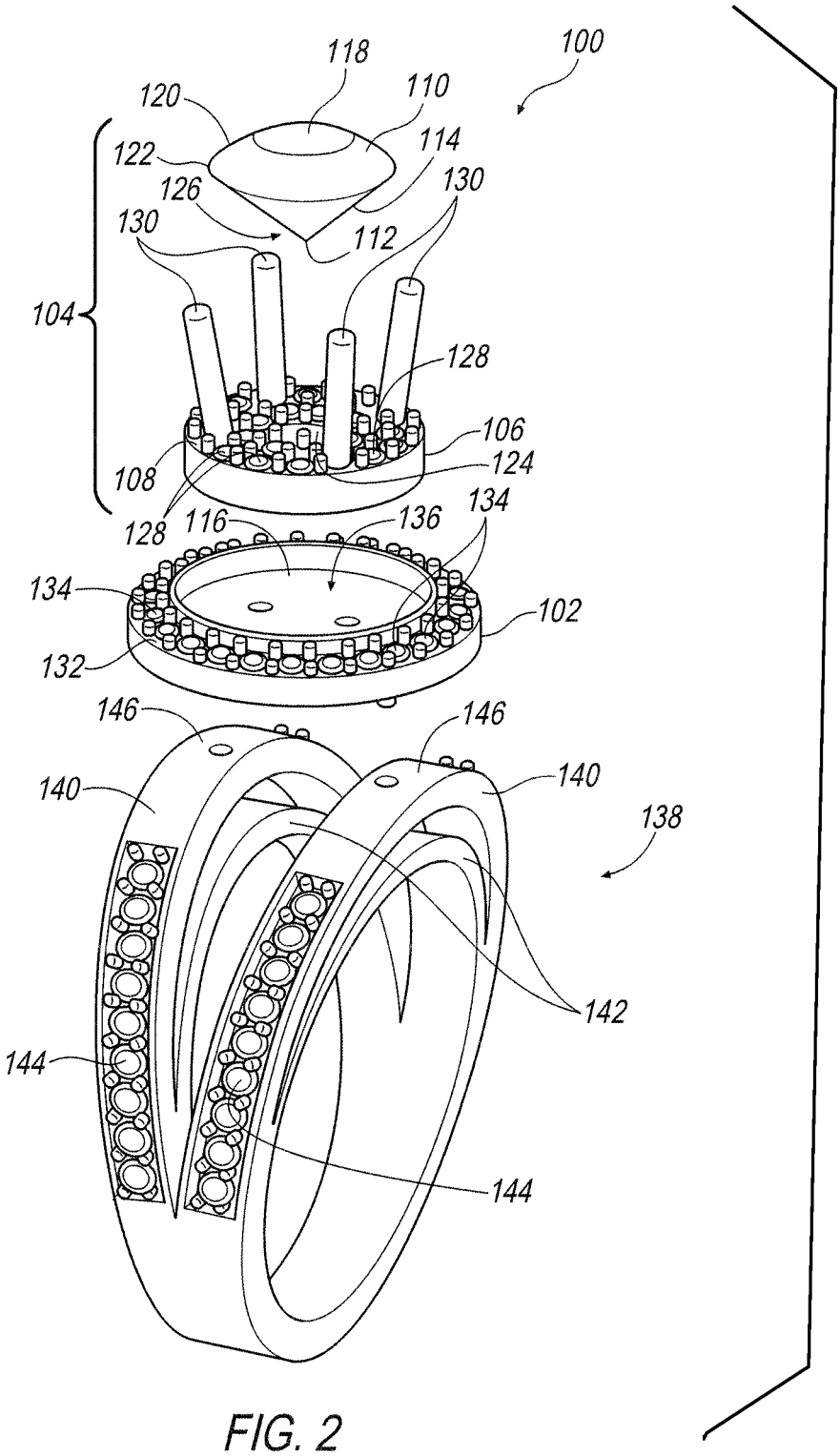
FIG. 2 is a perspective view of the jewelry assembly of FIG. 1 in exploded view.

FIG. 1 is a perspective view of a jewelry assembly as-assembled, and FIG. 2 is a perspective view of a jewelry assembly in exploded view. Referring to FIGS. 1 and 2, according to the disclosure, a jewelry assembly 100 includes a base support 102, and a sub-assembly 104 attached to base support 102. Sub-assembly 104 includes a base plate 106 having an upper e surface 108. Sub-assembly 104 includes a center stone 110 having a culet 112 and a pavilion 114, and at least a main portion of center stone 110 positioned above the upper surface 108. Base support 102 includes a central upper surface 116 that matches with the upper surface 108 of base plate 106. In the illustrated example, center stone 110 includes culet 112 and pavilion 114, as well as a table 118, a crown 120, and a girdle 122. Center stone 110, although illustrated having generally smooth surfaces for pavilion 114, table 118, crown 120, and girdle 122, is contemplated to include flat and faceted surfaces as is commonly known with diamond and other precious stones. Thus, in one example, center stone 110 is a diamond, however it is contemplated that center stone 110 may be a ruby, a sapphire, an emerald, a blue stone, or a birth stone, as examples.

Base plate 106 includes, in the illustrated example, a center hole 124, and center stone 110 is positioned such that a portion 126 of culet 112 is positioned within center hole 124. A plurality of secondary jewelry stones 128, which are smaller than the center stone, are positioned on the upper surface 108, such that secondary jewelry stones 128 are visible, in one example, beneath pavilion 114 of center stone 110. As shown, the secondary jewelry stones 128 surround a center of the upper surface of the base plate 106 such that the secondary jewelry stones 128 are visible around the center stone 110, and the secondary jewelry stones 128 may be disposed at a level which is near a level of a culet of the center stone 110.

A plurality of prongs 130 extend from the upper surface 108 of base plate 106. Prongs 130 are positioned to support and mechanically constrain center stone 110. Base support 102 includes a halo or outer circular band 132 of tertiary jewelry stones 134 positioned to circumscribe base plate 106. In one example, one or both of secondary jewelry stones 128 and tertiary jewelry stones 134 are diamond.

Base support 102 includes central upper surface 116 and is formed in a depression 136 of base support 102, depression 136 having a shape of or corresponding to base plate 106. In the illustrated example, base plate 106 is generally circular, thus it is contemplated that depression 136 is generally circular as well, such that base plate 106 is positioned within depression 136 and on central upper surface 116. It is contemplated, however, that any shape may be employed for base plate 106 and its corresponding depression 136, such as oval, cushion, pear, marquise, square, heart, or half-moon, as examples.

Jewelry assembly 100 includes a band or ring 138 having shanks 140 and bridges 142. And, although two shanks 140 and two bridges or metal bands 142 are illustrated, it is contemplated that ring 138 may include a single shank 140 and bridge or metal band 142. Shanks 140 include optionally additional stones 144, which in one example are diamonds, but may be of any type of stone as disclosed herein. Also, base support 102 is positioned on one or more shanks 140 that are a metal band, e.g., as depicted the base support extends across and is connected to the shanks 140 and the base plate 106 is also positioned above the shanks and the gap between the shanks. Further, although ring 138 having shanks 140 and bridges 142 are illustrated, in lieu thereof the jewelry may instead include bracelets, brooches, and other types of jewelry as well.

In addition, although base support 102 is illustrated in FIGS. 1 and 2, it is contemplated that jewelry assembly 100 may forego base support 102, and sub-assembly 104 may be supported directly by a support 146. That is, sub-assembly 104 may be attached directly to and supported by support 146, foregoing the use of base support 102 having tertiary jewelry stones 134 and depression 136. Thus, according to one example, jewelry assembly 100 includes support 146, sub-assembly 104 attached directly to support 146, sub-assembly 104 including base plate 106 having the upper surface 108, and center stone 110 having pavilion 114 positioned above the upper surface 108. Thus, whether jewelry assembly 100 includes, or does not include, base support 102, in general sub-assembly 104 is supported by a support, which in one example is base support 102, and in another example, is support 146.

Figure 3:
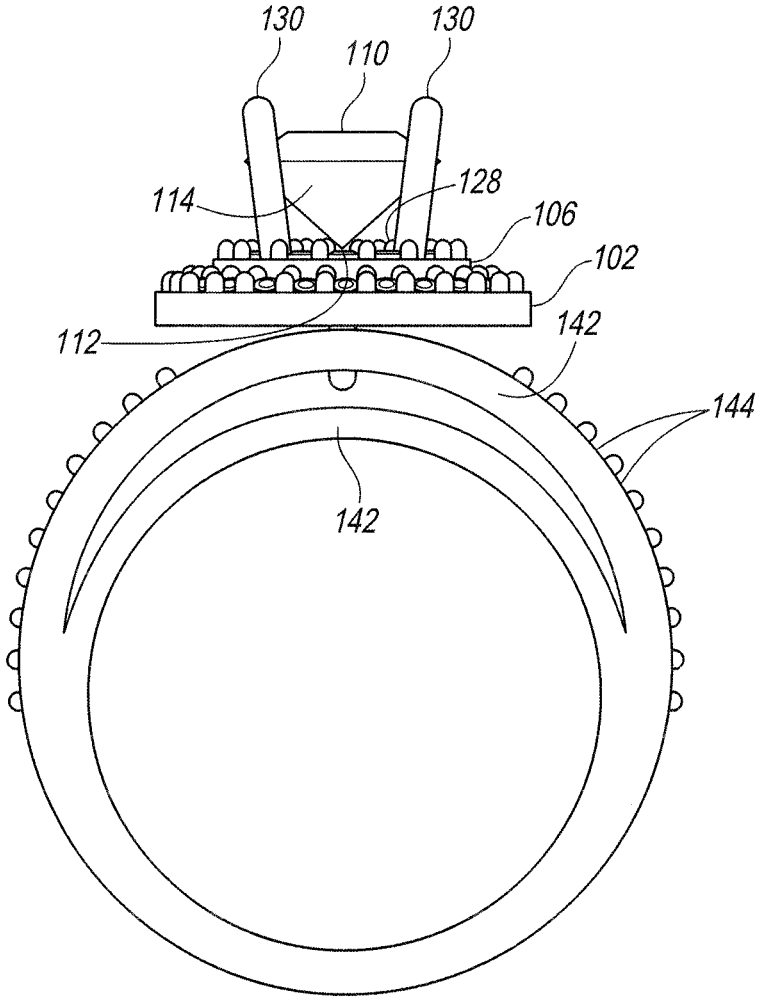
FIG. 3 is a side view of the jewelry assembly of FIGS. 1 and 2, but having a center stone positioned above a base plate.

FIG. 3 is a side view of jewelry assembly 100 of FIGS. 1 and 2, but having center stone 110 positioned above base plate 106. As can be seen, center stone 110 includes culet 112 and pavilion 114, which are clearly visible and positioned above base plate 106. Thus, although FIGS. 1 and 2 correspond with FIG. 3, jewelry assembly 100 of FIG. 3 does not include a hole (such as center hole 124 as illustrated in FIGS. 1 and 2) into which culet 112 is positioned, whereas jewelry assembly 100 of FIGS. 1 and 2 includes center hole 124 in base plate 106 into which culet 112 is positioned. Thus, FIG. 3 includes an example in which center stone 110 is positioned having culet 112 and pavilion 114 above base plate 106.

Figure 4:
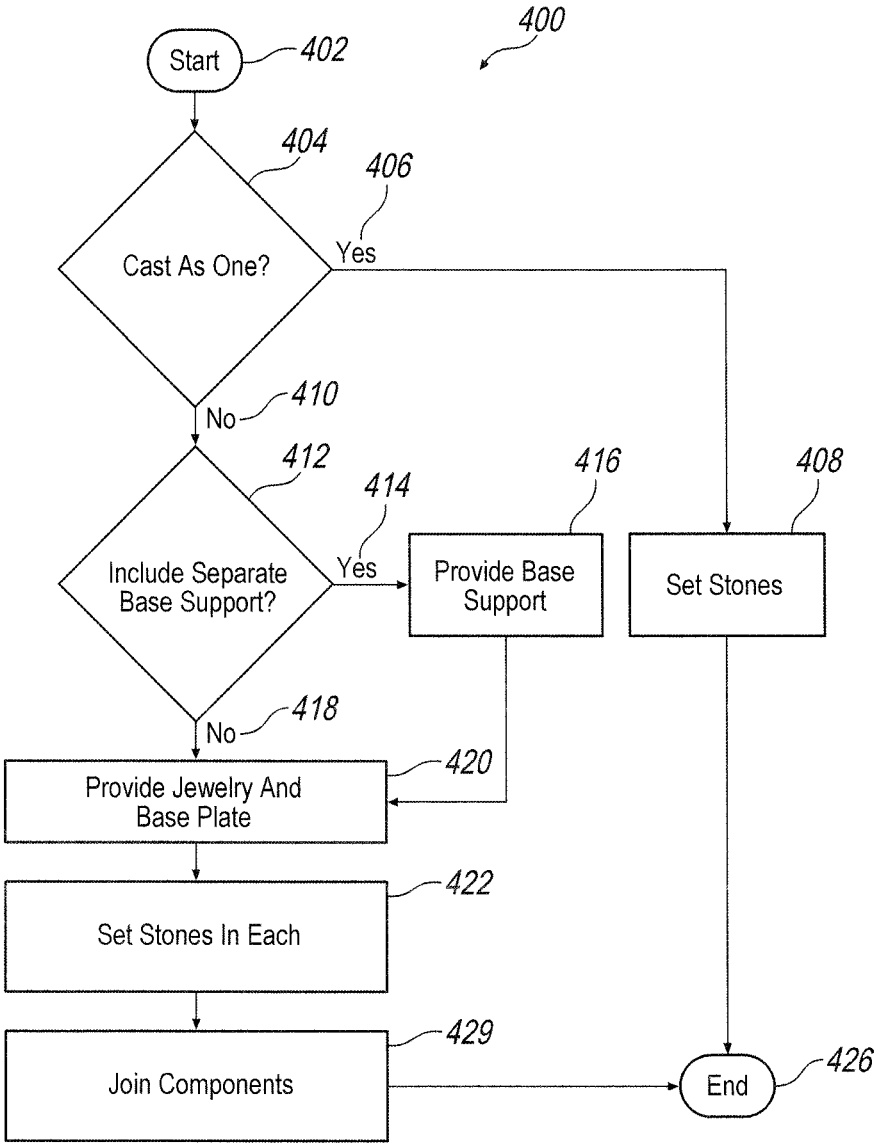
FIG. 4 discloses a method of assembly of the disclosed jewelry assemblies according to an embodiment of the present invention.

FIG. 4 discloses a method of assembly 400 of jewelry assembly 100, to include Various contingencies and various options depending on the desired final assembly. For instance, as discussed, parts may be cast as one and then have the stones set therein. Parts may be cast separately and joined together. Assembly 100 may include base support 102, or in an alternative base plate 106 may be attached directly, such as to ring 138.

Method 400 starts at step 402, and at step 404 is determined whether all components will be cast as one or not. If so 406, then components such as base plate 106 and ring 138 may be cast as one, and if base support 102 is to be included, then base support 102 may be cast at step 406 as well. At step 408 stones are set in each of base plate 106, ring 13 8, and base support 102, or any combination thereof. On the other hand, if components will not be cast as one 410, then next method 400 determines at step 412 whether base support 102 is included in the final assembly or not. If so 414, then at step 416 base support 102 is provided. And, if not 418, then at step 420 jewelry such as ring 138, as well as base plate 106 are provided. At step 422 stones are set in each, and at step 424 components are joined together. Method 400 ends at step 426.

Accordingly, and as previously discussed, disclosed is a method of fabricating the jewelry or gemstone setting. Support for center stone 110 and base plate 106 may be cast as one piece, such that center stone 110 and any secondary stones may then be assembled as one piece. In this example, the center stone and any additional stones (such as the secondary stones) may be of a type that mayor may not be capable of taking a high degree of heat without damage. That is, a single piece casting enables a flexible design that can incorporate any type of stone. In addition, casting as a single piece will result in a single material type.

Also disclosed, in another example, base plate 106 may be fabricated separate from its support, which may be base support 102, or in an alternative directly to support 146. In this example, secondary stones may be attached to base plate 106, but having stones that are not capable of taking a high degree of heat. Stones may be placed into a portion of the setting, and then base plate 106 may be laser-soldered, as an example, to support (base support 102 or support 146) using a low-temperature process, such as laser soldering, so as not to damage the stones on, for instance, base plate 106.

Accordingly, and more generally, disclosed is a method 400 of fabricating a jewelry assembly that includes providing support, such as base support 102 or support 146, attaching a sub-assembly such as sub-assembly 104 to support 102, 146, sub-assembly 146 including base plate 106 having an upper surface 108, and positioning center stone 110 having culet 112 and pavilion 114 above the upper surface 108. Regardless of whether components are cast as one, or cast separately, the disclosed method 400 includes, in one example, forming center hole 124 in base plate 106, and positioning center stone 110 such that a portion of culet 112 is positioned within center hole 104. The disclosed method 400 further includes positioning a plurality of secondary jewelry stones 128 on the upper surface 108, such that plurality of secondary jewelry stones 128 is visible beneath center stone 110.

The disclosed method 400 further includes, in one example, positioning circular band of tertiary jewelry stones 134 to circumscribe base plate 102, on for instance base support 102, wherein at least one of center stone 110, secondary jewelry stones 128, and tertiary jewelry stones 134 is diamond. Method 400 further includes extending plurality of prongs 130 from the upper surface 108 of base plate 106, and positioning prongs 130 to support and mechanically constrain the center stone. Disclosed method 400 further includes, in one example, forming central upper surface 116 in depression 136 of base support 102, depression 136 having a shape of base plate 106, and positioning base plate 106 within depression 136 and on central upper surface 116. The disclosed method 400 further includes positioning support, such as base support 102, on shank 140 of a metal band.

Figure 5:
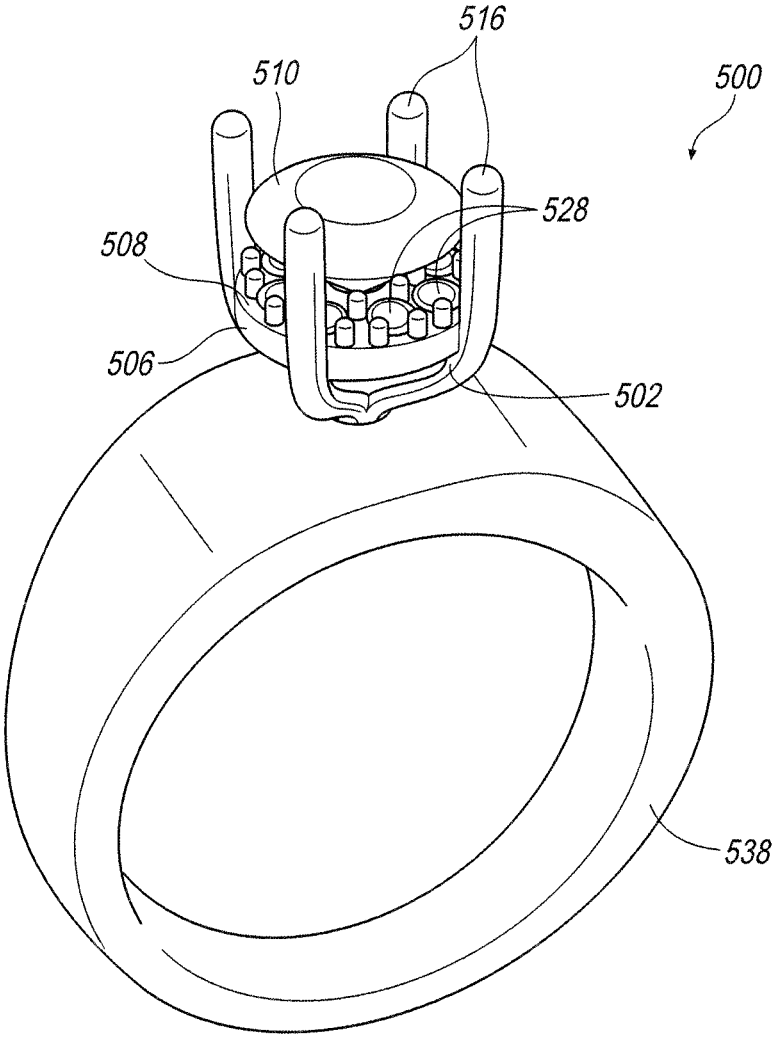
FIG. 5 is a perspective view of another jewelry assembly according to an embodiment of the present invention as-assembled.
Figure 6:
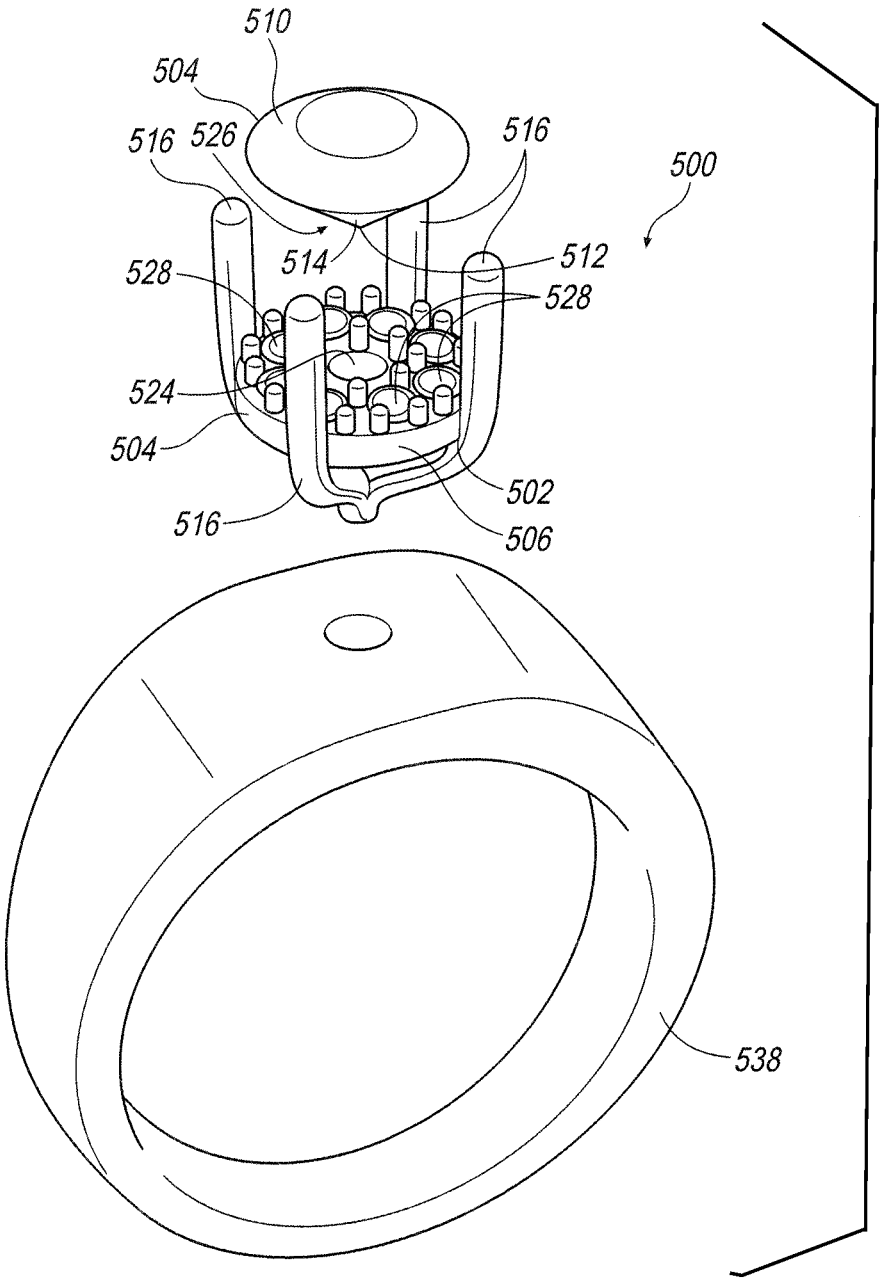
FIG. 6 is a perspective view of the jewelry assembly of FIG. 5 in exploded view.

According to another example, FIG. 5 is a perspective view of a jewelry assembly as assembled, and FIG. 6 is a perspective view of a jewelry assembly in exploded view. Referring to FIGS. 5 and 6, according to the disclosure, a jewelry assembly 500 includes a base support 502, and a sub-assembly 504 attached to base support 502. Sub-assembly 504 includes a base plate 506 having an upper surface 508. Sub-assembly 504 includes a center stone 510 having a culet 512 and a pavilion 514 positioned above the upper surface 508. Base support 502 includes a plurality of prongs 516 (which, in the illustrated example, are not included as sub-assembly 504). In the illustrated example, center stone 510 includes culet 512 and pavilion 514, as well as a table, a crown, and a girdle. Center stone 510, although illustrated having generally smooth surfaces for the pavilion, the table, the crown, and the girdle, is contemplated to include flat and faceted surfaces as is commonly known with diamond and other precious stones. Thus, in one example, center stone 510 is a diamond, however it is contemplated that center stone 510 may be a ruby, a sapphire, an emerald, a blue stone, or a birth stone, as examples.

Base plate 506 includes, in the illustrated example, a center hole 524, and center stone 510 is positioned such that a portion 526 of culet 512 is positioned within center hole 524. A plurality of secondary jewelry stones 528 are positioned on the upper surface 508, such that secondary jewelry stones 528 are visible beneath culet 512 and pavilion 514 of center stone 510.

Prongs 516 extend from base support 502. Prongs 516 are positioned to support and mechanically constrain center stone 510. In one example, secondary jewelry stones 528 are diamond. Jewelry assembly 500 includes a band or ring 538, although it is contemplated that other jewelry may instead include bracelets, brooches, and other types of jewelry as well.

Figure 7:
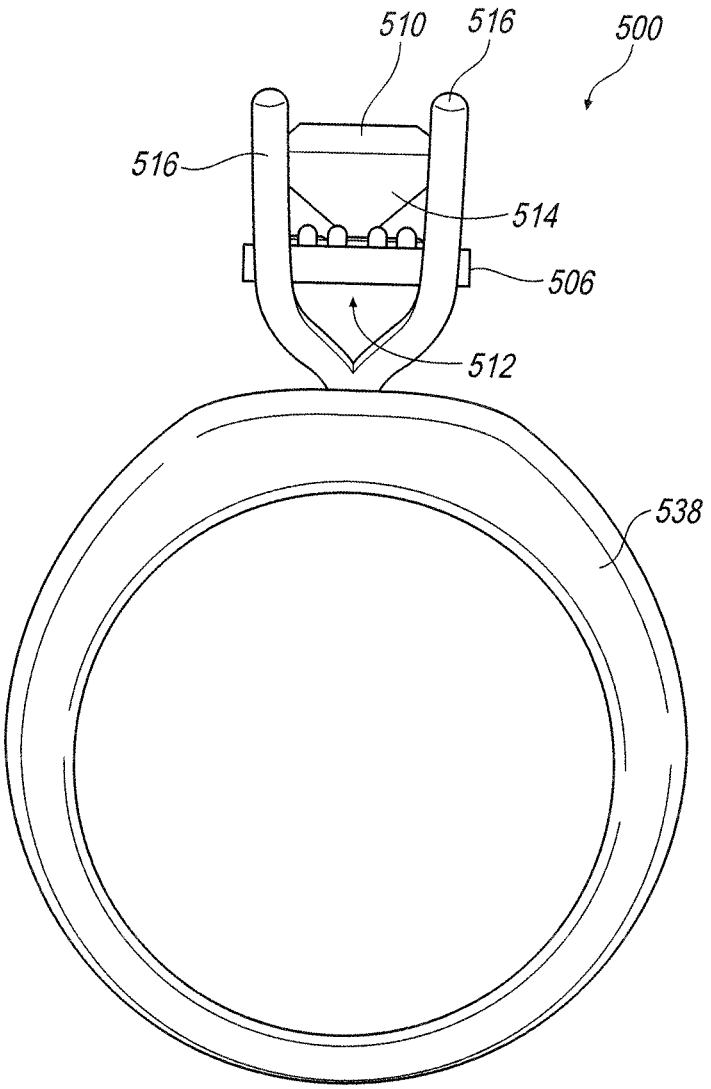
FIG. 7 is a side view of the jewelry assembly of FIGS. 5 and 6.

FIG. 7 is a side view of jewelry assembly 500 of FIGS. 5 and 6, having center stone 510 positioned within center hole 524 of base plate 506. As can be seen, center stone 510 includes culet 512 and pavilion 514, positioned within base plate 506. According to the disclosure, jewelry assembly 500 is fabricated with a method that is described above and with respect to method 400, having options to cast as one piece and then place stones, or to cast separately as sub-assembly 504 and as base support 502/ring 538.

Figure 8:
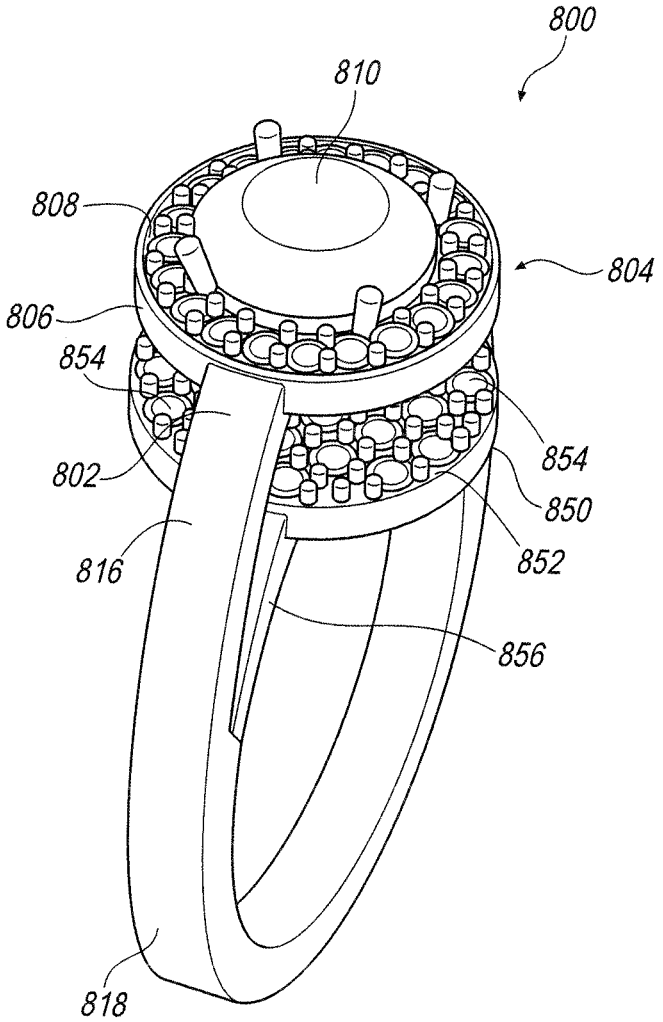
FIG. 8 is a perspective view of another jewelry assembly according to an embodiment of the present invention as-assembled.
Figure 9:
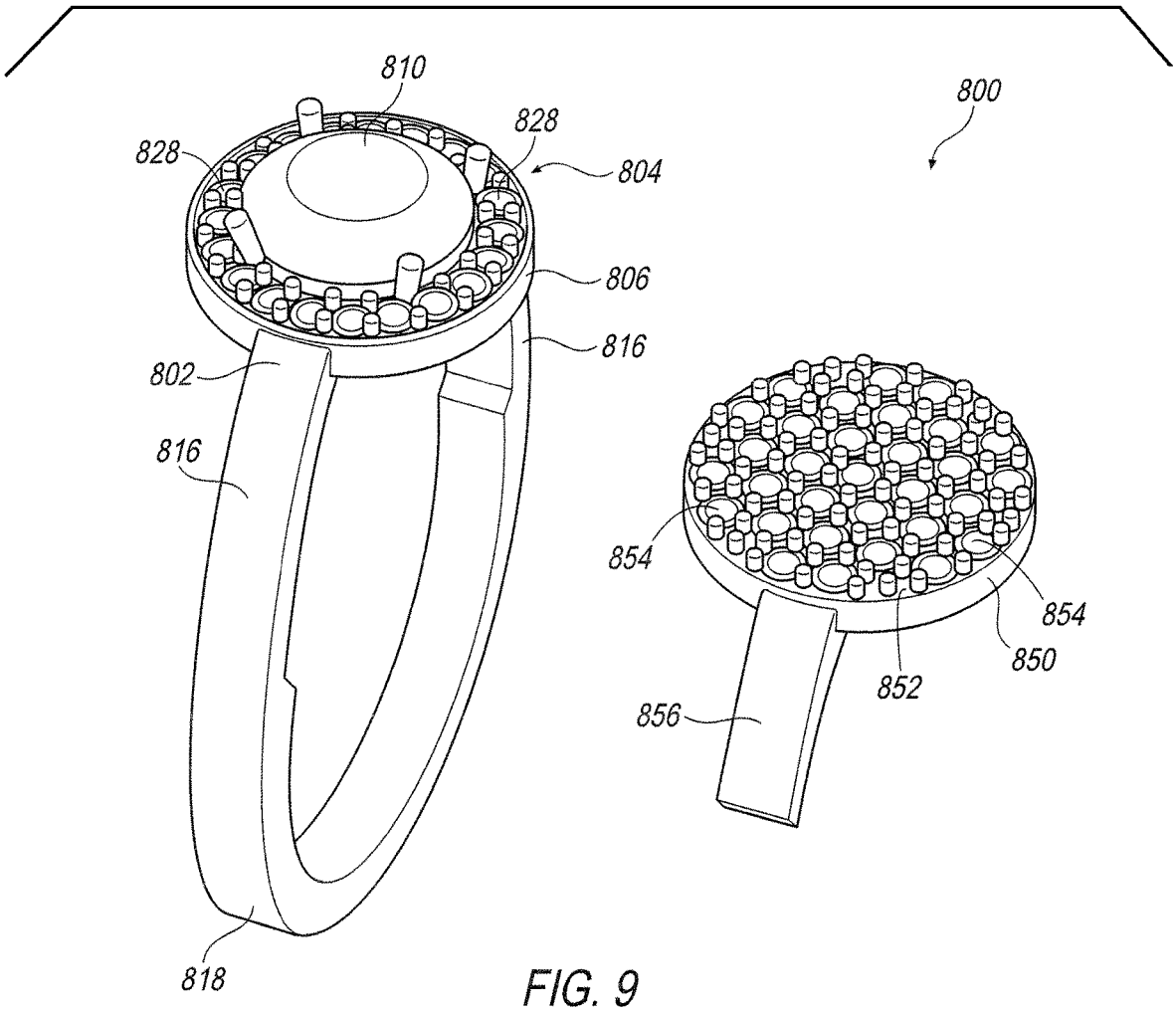
FIG. 9 is a perspective view of the jewelry assembly of FIG. 8 in exploded view.
Figure 10:
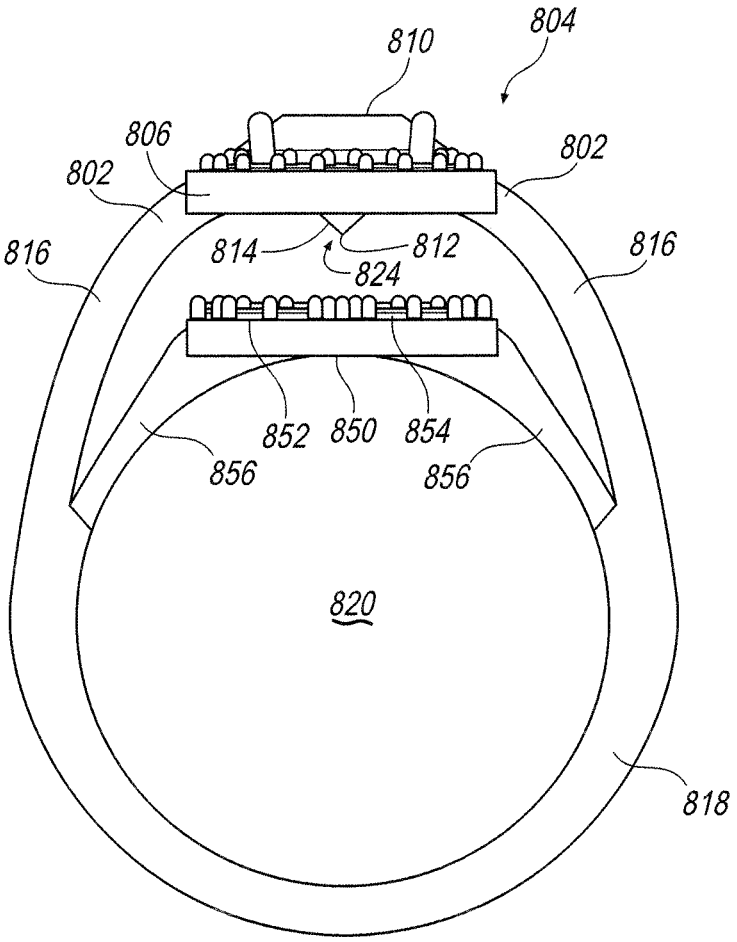
FIG. 10 is a side view of the jewelry assembly of FIGS. 8 and 9.

According to another example, FIG. 8 is a perspective view of a jewelry assembly as assembled, and FIG. 9 is a perspective view of a jewelry assembly in exploded view. FIG. 10 shows a side view of the corresponding jewelry assembly. Referring to FIGS. 8, 9, and 10, according to the disclosure a jewelry assembly 800, referred in one example as a "double-decker" design, includes a base support 802, and a sub-assembly 804 attached to base support 802. Sub-assembly 804 includes a base plate 806 having an upper surface 808. Sub-assembly 804 includes a center stone 810 having a culet 812 and a pavilion 814 positioned above the upper surface 808. Base support 802 includes a metal band 818, and sub-assembly 804 with the center stone 810 is supported and mechanically constrained with a pair of shanks 816 that are attached to metal band 818.

In the illustrated example, center stone 810 includes culet 812 and pavilion 814, as well as a table, a crown, and a girdle. Center stone 810, although illustrated having generally smooth surfaces for the pavilion, the table, the crown, and the girdle, is contemplated to include flat and faceted surfaces as is commonly known with diamond and other precious stones. Thus, in one example, center stone 810 is a diamond, however it is contemplated that center stone 810 may be a ruby, a sapphire, an emerald, a blue stone, or a birth stone, as examples.

Base plate 806 includes, in the illustrated example, a center hole 824 (not visible, but evident in FIG. 10 in which culet 812 is seen extending or passing through base plate 806), and center stone 810 is thus positioned such that at least a portion of culet 812 is positioned within or through center hole 824. A plurality of secondary jewelry stones 828 are positioned on the upper surface 808, such that secondary jewelry stones 828 are surround the pavilion 814 of center stone 810.

Shanks 816 extend from metal band 818 and form base support 802. Shanks 816 are positioned to support and mechanically constrain the base plate 806 with the center stone 810. In one example, secondary jewelry stones 828 are diamond. Jewelry assembly 800 includes metal band 818, although it is contemplated that other jewelry may instead include bracelets, brooches, and other types of jewelry as well.

In addition, jewelry assembly 800 includes a second base support 850, positioned beneath base support 802. Second base support 850 includes a an upper surface 852 on which tertiary stones 854 are positioned to substantially cover the entire surface 852 and are visible from any angle surrounding the center stone 810. As shown, many of the tertiary stones 854 in a center portion of the surface 852 are positioned directly beneath the culet and pavilion of the center stone 810. Second base support 850 is supported by secondary supports or shanks 856, which extend from metal band 818, forming in the example shown a passage 820 through which a finger may pass.

According to the disclosure, jewelry assembly 800 is fabricated with a method that is described above and with respect to method 400, having options to cast as one piece and then place stones, or to cast separately as sub-assembly 804 and as base support 802/metal band 818/second base support 850.

Figure 11:
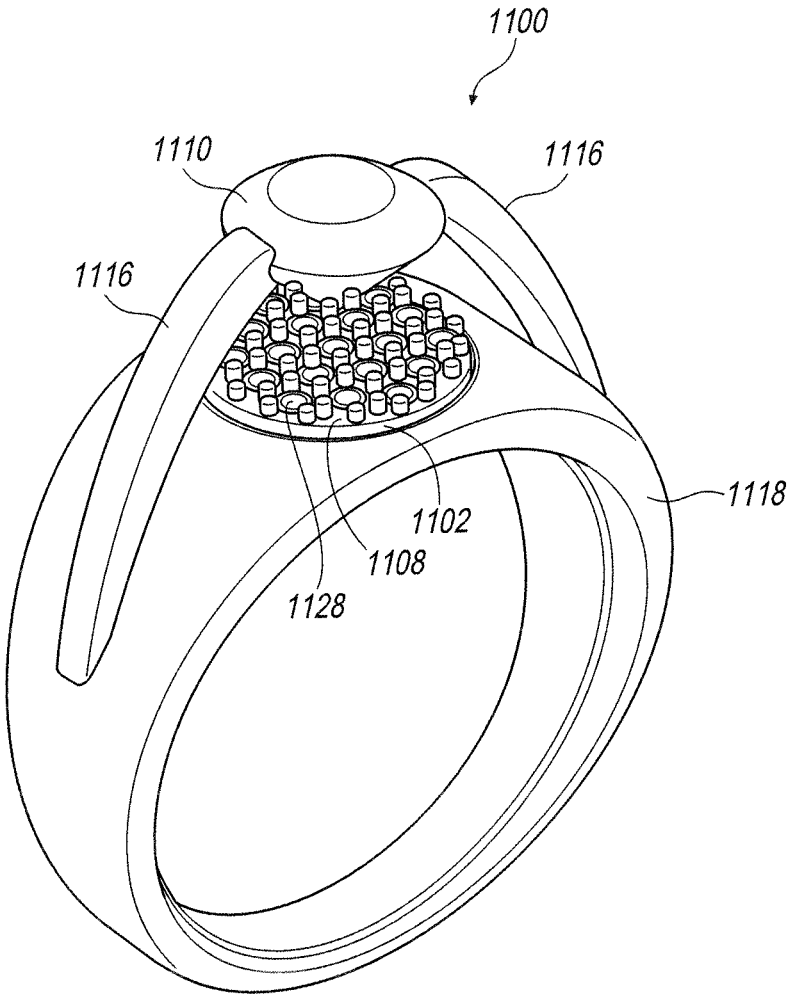
FIG. 11 is a perspective view of another jewelry assembly according to an embodiment of the present invention as-assembled.
Figure 12:
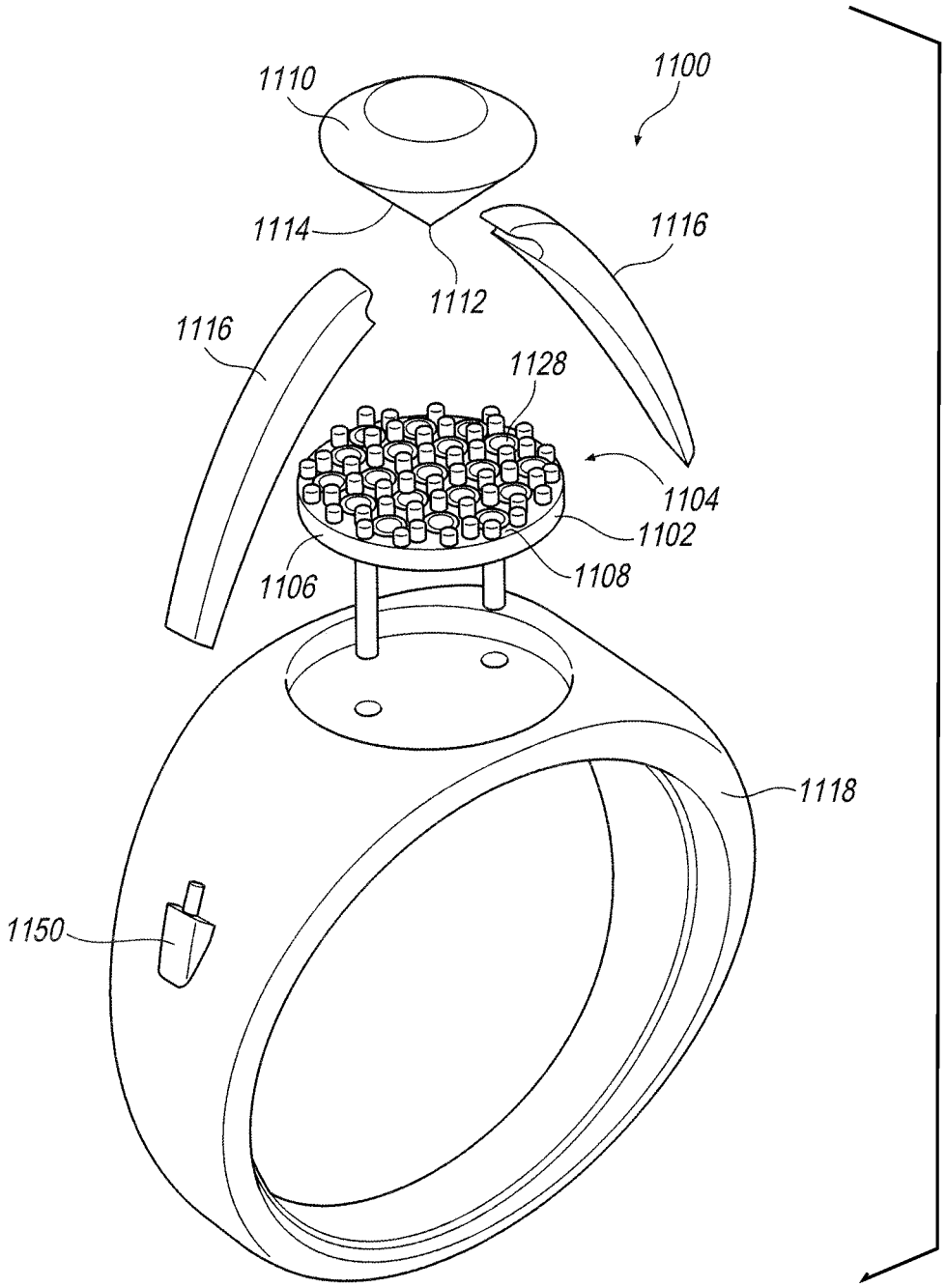
FIG. 12 is a perspective view of the jewelry assembly of FIG. 11 in exploded view.

According to another example, FIG. 11 is a perspective view of a jewelry assembly as assembled, and FIG. 12 is a perspective view of a jewelry assembly in exploded view. Referring to FIGS. 11 and 12, according to the disclosure, a jewelry assembly 1100 includes a base support 1102, and a sub-assembly 1104 attached to base support 1102. Sub-assembly 1104 includes a base plate 1106 having an upper surface 1108. Sub-assembly 1104 includes a center stone 1110 having a culet 1112 and a pavilion 1114 positioned above the upper surface 1108. In the illustrated example, center stone 1110 includes culet 1112 and pavilion 1114, as well as a table, a crown, and a girdle. Center stone 1110, although illustrated having generally smooth surfaces for the pavilion, the table, the crown, and the girdle, is contemplated to include flat and faceted surfaces as is commonly known with diamond and other precious stones. Thus, in one example, center stone 1110 is a diamond, however it is contemplated that center stone 1110 may be a ruby, a sapphire, an emerald, a blue stone, or a birth stone, as examples.

A plurality of secondary jewelry stones 1128 are positioned on the upper surface 1108, such that secondary jewelry stones 1128 are visible beneath culet 1112 and pavilion 1114 of center stone 1110.

Supports 1116 are a type of prong and extend from base support 1102 and more specifically from a ring or band 1118. Supports 1116 are positioned to support and mechanically constrain center stone 1110. In one example, secondary jewelry stones 1128 are diamond. Jewelry assembly 1100 includes band or ring 1118, although it is contemplated that other jewelry may instead include bracelets, brooches, and other types of jewelry as well. In one example, an engagement device 1150 is attached to band or ring 1118, which itself supports and engages with supports 1116 (on each side of center stone 1110).

Figure 13:
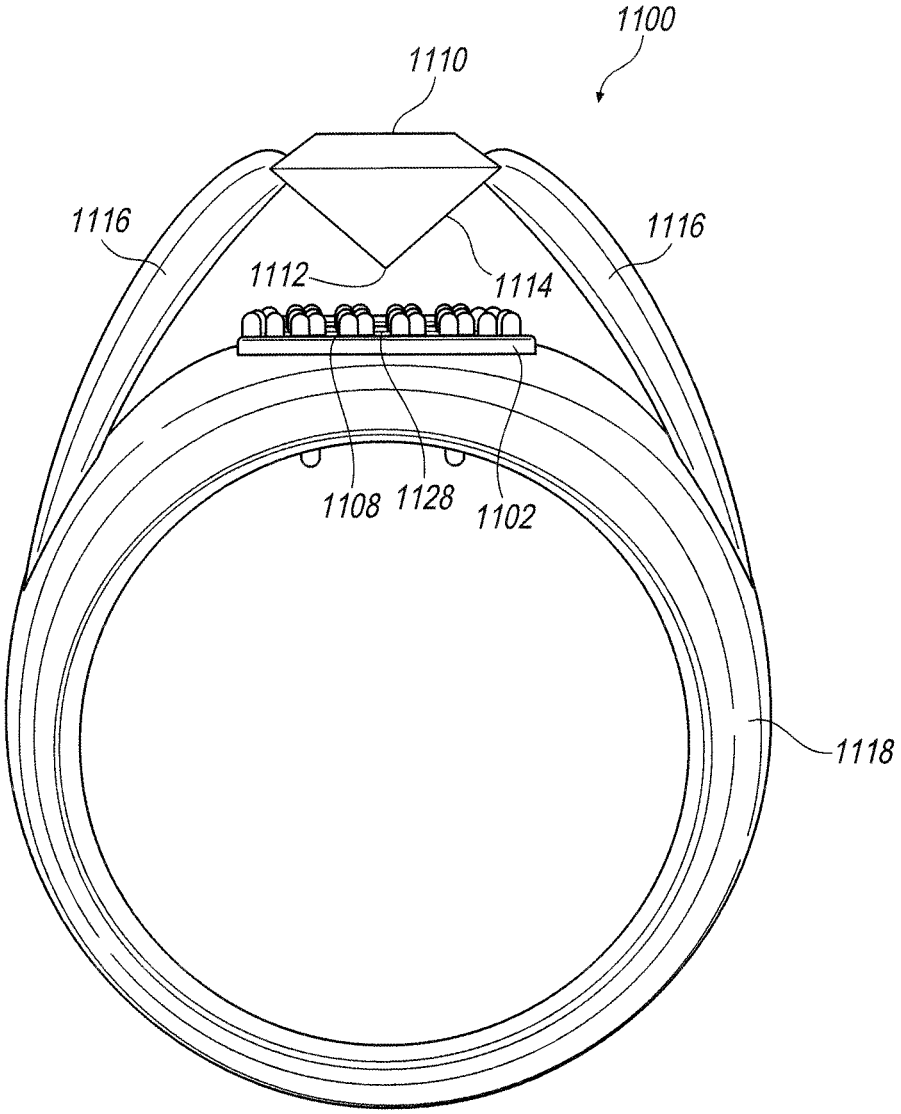
FIG. 13 is a side view of the jewelry assembly of FIGS. 11 and 12.

FIG. 13 is a side view of jewelry assembly 1100 of FIGS. 11 and 12, having center stone 1110 above base plate 1106. As can be seen, center stone 1110 includes culet 1112 and pavilion 114, positioned above base plate 1106, however it is contemplated, as with the other examples, that base plate 1106 includes a center hole (not shown) which includes culet 1112 projecting or extending therein. According to the disclosure, jewelry assembly 1100 is fabricated with a method that is described above and with respect to method 400, having options to cast as one piece and then place stones, or to cast separately as sub-assembly 1104 and as base support 1102/ring 1118 and supports 1116.

Figure 14:
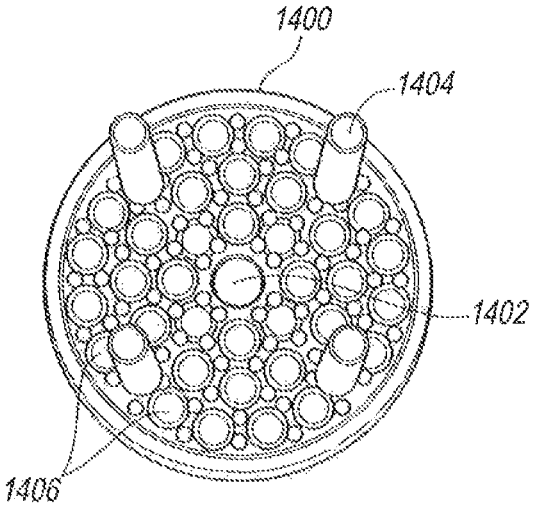
FIG. 14 is an example of a base support according to an embodiment of the present invention.
Figure 15:
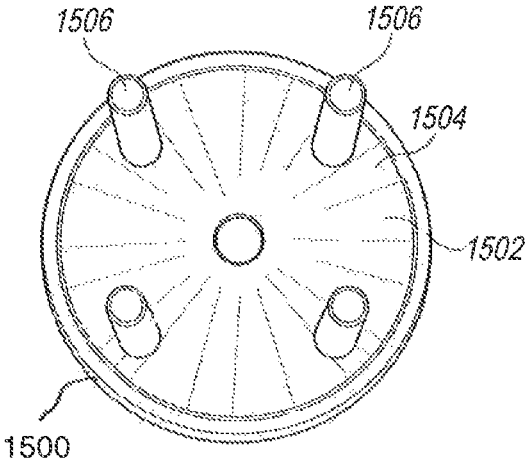
FIG. 15 is an example of a base support according to an embodiment of the present invention.
Figure 16:
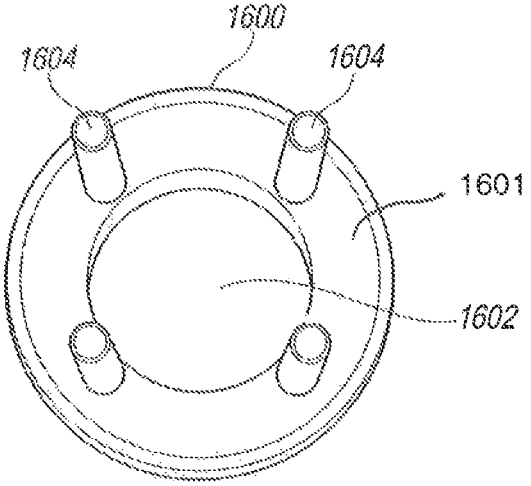
FIG. 16 is an example of a base support according to an embodiment of the present invention.

According to the disclosure, disclosed base plates may be fabricated from different materials and having different arrangements than previously disclosed. That is, base supports 102, 502, 802, and 1102, having been described as having a flat surface for placement of secondary stones, may instead include other arrangements to create a different visual appearance. Referring first to FIG. 14, a base support 1400 corresponding generally with base support 102 is shown, it having a center hole 1402 and prongs 1404. Base support 1400 includes, in this example, secondary stones 1406 corresponding with the above description in the examples. In fact, base support 1400 applies generally to the examples disclosed herein, providing the ability to separately fabricate a sub-assembly of components, to include secondary stones 1406, as well as a center stone positioned within prongs 1404, which may then be separately assembled and then subsequently attached to a larger jewelry assembly. However, referring to FIG. 15 and in another example, base supports 102, 502, 802, and 1102 may include instead a base support 1500 having an illusion and faceted surface, and having facets 1502, 1504, that enhance a center stone, as described above, positioned within prongs 1506. In this example, base support 1500, having a generally faceted surface and no secondary stones, may be particularly applicable to not only faceted center stones, but unfaceted as well. For example, a cabochon (i.e., gem polished but not faceted) may be positioned in prongs 1506, such that facets 1502, 1504 further enhance the features of the center stone. Referring to FIG. 16, and in another example, base supports 102, 502, 802, and 1102 may include instead a base support 1600 having an onyx surface 1601 positioned below a center stone, as described above, positioned within prongs 1604. In this example, a single center stone may be positioned within prongs 1604. A center hole 1602 may be included within surface 1601, to enable placement of a center stone having a culet positioned therein. Thus, surface 1601 may enhance the features of a center stone. Surface 1601, although indicated as onxy, may in fact be any material that enhances a center stone, and surface 1601 may be flat or faceted.

It is to be understood that the above description is intended to be illustrative and not restrictive. Many applications other than the examples provided would be upon reading the above description. The scope of the disclosure should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, the disclosure is capable of modification and variation and is limited only by the following claims.

All terms used in the claims are intended to be given their broadest reasonable constructions and their ordinary meanings as understood by those skilled in the art unless an explicit indication to the contrary in made herein. Use of the singular articles such as "a," "the," "said," etc. should be read to recite one or more of the indicated elements unless a claim recites an explicit limitation to the contrary.

What is claimed is:

1. A jewelry ring, comprising:

a metal band;

a base plate attached to the metal band, the base plate having an upper surface;

a second plate intermediate the base plate and the metal band, wherein the base plate is indirectly connected to the metal band through the second plate;

a center stone having a culet and a pavilion;

a plurality of secondary jewelry stones which are smaller than the center stone and are secured to the upper surface of the base plate; and a plurality of prongs which extend from the base plate to the center stone and set the center stone relative to the base plate such that the entire center stone is positioned above the upper surface of the base plate and above the secondary jewelry stones, wherein the secondary jewelry stones cover a central portion of the upper surface of the base plate such that many of the secondary jewelry stones are disposed directly beneath and visible beneath the pavilion of the center stone, wherein the culet of the center stone is disposed adjacent to the base plate, a portion of the metal band includes a pair of shanks having a gap between the shanks, and the second plate is connected to the pair of shanks, and most of the pavilion is directly exposed to view from outside of the jewelry ring.

2. The jewelry ring of claim 1, wherein the base plate is supported on a central portion of the second plate and a circular band of tertiary jewelry stones is also provided on the second plate and positioned to circumscribe the base plate.

3. The jewelry ring of claim 2, wherein at least one of the secondary jewelry stones and or the tertiary jewelry stones is diamond.

4. The jewelry ring of claim 1, wherein lower ends of the plurality of prongs are connected to the base plate and extend upward from the base plate to engage the center stone.

5. The jewelry ring of claim 1, wherein the center stone is a diamond.

6. The jewelry ring of claim 1, wherein the jewelry center stone and many of the secondary jewelry stones are diamonds, and the center stone pavilion is faceted.

7. A jewelry ring, comprising:

a metal band;

a base plate attached to the metal band, the base plate having an upper surface;

a center stone having a culet and a pavilion;

a plurality of secondary jewelry stones which are smaller than the center stone and are secured to the upper surface of the base plate;

a plurality of prongs which extend from the base plate to the center stone and set the center stone relative to the base plate such that most of the center stone is positioned above the upper surface of the base plate and above the secondary jewelry stones; and a second plate intermediate the base plate and the metal band, wherein the base plate includes a hole at a center thereof, the center stone is positioned such that the culet is disposed at least partially within the hole, the secondary jewelry stones cover a central portion of the upper surface of the base plate surrounding the hole such that many of the secondary jewelry stones are disposed directly beneath and visible beneath the pavilion of the center stone, most of the pavilion is directly exposed to view from outside of the jewelry ring, the base plate is indirectly connected to the metal band through the second plate, the base plate is supported on a central portion of the second plate, a circular band of tertiary jewelry stones is also provided on the second plate and positioned to circumscribe the base plate, and a portion of the metal band includes a pair of shanks having a gap between the shanks, and the base plate is positioned above the pair of shanks and the gap.

8. The jewelry ring of claim 7, wherein at least one of the secondary jewelry stones and or the tertiary jewelry stones is diamond.

9. The jewelry ring of claim 7, wherein lower ends of the plurality of prongs are connected to the base plate and extend upward from the base plate to engage the center stone.

10. The jewelry ring of claim 7, wherein the jewelry center stone and many of the secondary jewelry stones are diamonds, and the center stone pavilion is faceted.

* * * * *